United States Patent [19]

Farmer

[11] Patent Number: 5,038,551

[45] Date of Patent: Aug. 13, 1991

[54] SADDLE SEAT RISER PAD

[76] Inventor: Harold J. Farmer, 714 Fairway Dr; No. 206, Wauseon, Ohio 43567

[21] Appl. No.: 443,727

[22] Filed: Nov. 30, 1989

[51] Int. Cl.[5] ..... B68C 1/12

[52] U.S. Cl. ..... 54/66

[58] Field of Search ..... 54/65, 66

[56] References Cited

U.S. PATENT DOCUMENTS 103,276 5/1870 Allison ..... 54/66

296,748 4/1884 Harpham ..... 54/66

FOREIGN PATENT DOCUMENTS 80313 3/1920 Fed. Rep. of Germany ..... 54/66

*Primary Examiner*—Robert P. Swiatek

*Attorney, Agent, or Firm*—George R. Royer

[57] ABSTRACT

The subject device is a saddle backing, particularly but not solely adapted for English-type saddles, such device comprising a one-piece member having multiple curved portions that are basically in conformance with the back of a horse, such one-piece member having a frontal edge and a posterior edge, as well as two side edges, along with an upper surface and a lower surface, and wherein the forward edge has a height which is less than the rear edge, and wherein the side edges taper from a relatively larger width or height at the posterior end towards the frontal end and wherein the lower surface of the member is shaped in reciprocal conformance to the upper surface of the portion of the horse's back to which a saddle is generally appended. Such a device functions as a saddle riser pad.

3 Claims, 2 Drawing Sheets

SADDLE SEAT RISER PAD

BACKGROUND OF INVENTION AND DISCUSSION OF PRIOR ART

The subject invention relates to articles that are appended to a horse to facilitate a person riding the horse. In general, the main article that is used for riding is a saddle that is appended around the middle girth of a horse.

In most instances, prior to appending the saddle to the middle back of a horse, it is somewhat essential to place a blanket or some type of similar covering over the horse's back in order to prevent the saddle from chafing or rubbing against the horse's back. Without using a backing blanket, chafing or rubbing by the saddle can cause the back of the horse to become raw and injured thereby.

Blankets or other plastic coverings that are in present use for saddle backings are not generally adequate to fully protect the horse's back. One of the problems with such backing members is that they do not conform to the external surface of the horse's back and are thereby inadequate for this purpose. This is particularly true for western-type saddles, English saddles, or other types of saddles that are presently in use. This invention is therefore directed to this end and the following objects of the subject invention are directed accordingly.

OBJECTS OF INVENTION

It is an object of the subject invention to provide an improved device as a backing for a horse saddle;

Another object of the subject invention is to provide an improved backing for a horse saddle;

A further object of the subject invention is to provide an improved backing pad for an English saddle used on horses' backs;

Still another object of the subject invention is to provide an improved saddle pad for an English saddle.

DRAWINGS

DESCRIPTION OF GENERAL EMBODIMENT

Figure 1:
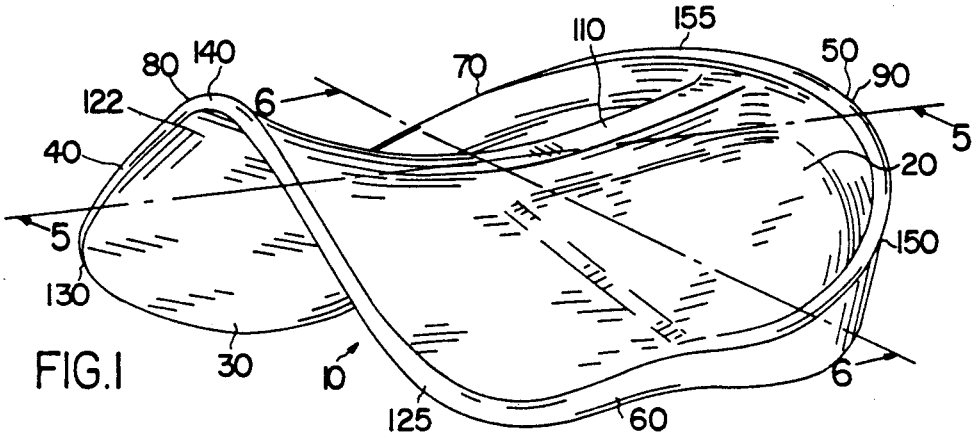
FIG. 1 is a perspective view of the subject invention.

The subject device is a saddle backing, particularly but not solely adapted for English-type saddles, such device comprising a one-piece member having multiple curved portions that are basically in conformance with the back of a horse, such one-piece member having a frontal edge and a posterior edge, as well as two side edges, along with an upper surface and a lower surface, and wherein the forward edge has a height which is less than the rear edge, and wherein the side edges taper from a relatively larger width or height at the posterior end towards the frontal end and wherein the lower surface of said member is shaped in reciprocal conformance to the upper surface of the portion of the horse's back to which a saddle is generally appended. Such a device functions as a saddle riser pad.

DESCRIPTION OF PREFERRED EMBODIMENT

The subject invention is a saddle backing for a riding saddle generally appended to the back of a horse, and while the preferred embodiment herein is directed to an embodiment for English-type saddles, it is to be understood that this invention is not to be limited to such types of saddles. Consequently, the subject invention, as set forth in the attached claims is not to be limited by the following description.

Referring now to the drawings, and particularly to FIGS. 1, 2, 3, 4, 5 and 6, in which a preferred embodiment of the subject invention is shown, a saddle backing member 10 is shown, such saddle backing being particularly adapted as a saddle backing for an English-type saddle. As shown, the saddle backing member 10 is a one-piece member having multiple contours on both its upper surface and lower surface. More specifically, the saddle backing member 10 has an upper surface 20 and a lower surface 30. Moreover, the saddle backing member 10 has a forward edge 40 and a posterior edge 50, and lateral edges 60 and 70.

Figure 3:
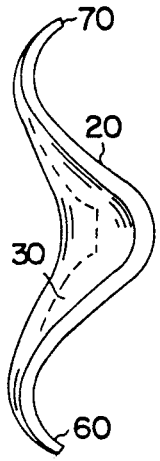
FIG. 3 is a front end elevational view of the subject invention.
Figure 4:
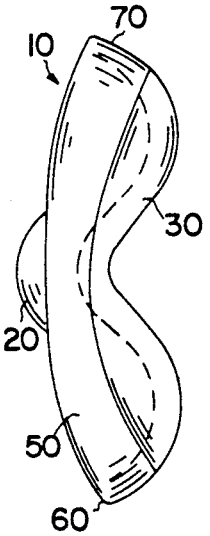
FIG. 4 is a posterior end elevational view of the subject invention.
Figure 5:
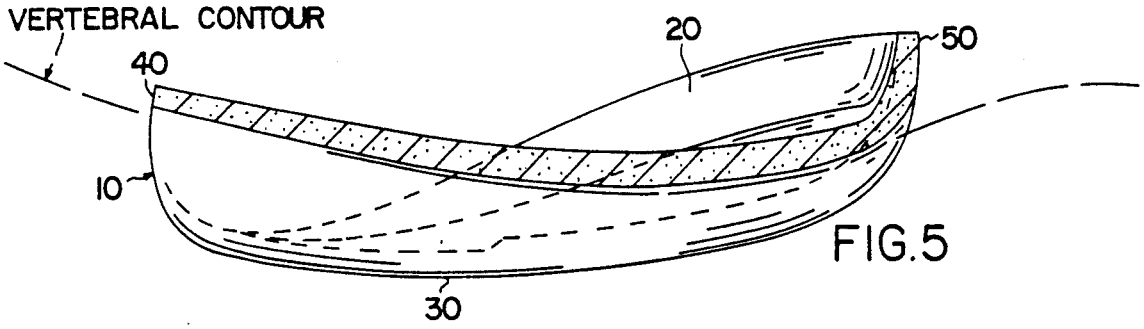
FIG. 5 is a side elevational view of the subject invention, in cross-sectional section configuration.
Figure 6:
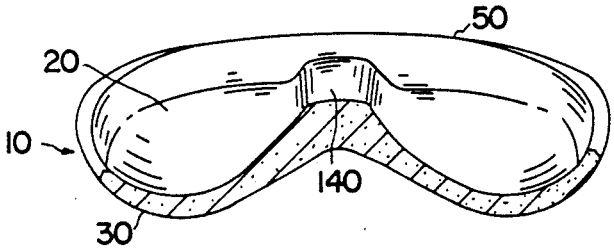
FIG. 6 is a frontal elevational view, in cross-section of the subject invention.

As can be seen in FIGS. 1, 3 and 4, the forward edge 40 of the saddle backing member 10 is relatively shorter in width or height than the posterior edge 50. As can be seen, therefore, the lateral edges 60 and 70 taper downwardly in height or thickness as such respective edges extend from the posterior edges 50 towards the frontal edge 40. This relative narrowing or tapering effect of the lateral edges 60 and 70 results in the forward edge 40 and thus the frontal portion 80 of the saddle backing member 10 is reduced in thickness relative to the posterior portion 90 of the saddle backing member 10.

As shown in FIGS. 1, 3, 4, 5 and 6, the saddle backing member has a general saddle-shaped configuration with an upper ridge 110 defining the uppermost portion of the upper surface saddle backing member 10. As shown in FIG. 1, the upper ridge 110 is curved in a concave manner as viewed from the side of the saddle backing member 10. The upper ridge 110 has a minimal width of the extreme upper surface of such upper surface of saddle backing member 10.

Moreover, as seen in FIG. 1, the upper surface 20 of such saddle backing member 10 is curved downwardly on each side in a sloping direction so that the upper surface has essentially a convex-shape with the ridge 110 forming the apex of such convex form. Correspondingly, the frontal edge 40 of the saddle backing member 10 is slightly V-shaped, from a front perspective view, as shown in the drawings. As seen in FIG. 1, the apex or crest 140 of the forward edge 40 forms the forward, upper portion of the saddle backing member 30, with the lower portions of the saddle backing member being formed by the side edges 60 and 70, and frontal edge 40 and posterior edge 50.

Figure 2:
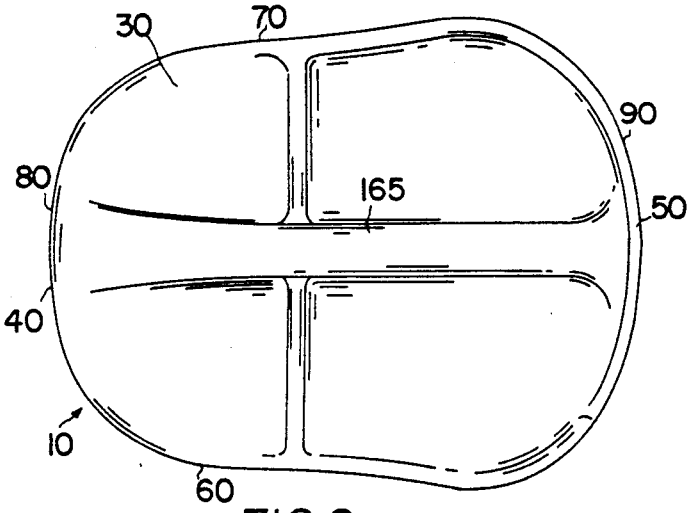
FIG. 2 is a top elevational view of the subject invention.

The lower surface 30 of the saddle backing member 10 is contoured in a concave manner, with multiple contours to fit conformingly over the horse's back, with a central longitudinally extending apex 165 forming the longitudinal central ridge in the lower surface 30, as seen in FIG. 2. The bottom corners of the saddle backing member are forward corners 125 and 130, as well as the posterior corners 150 and 155.

Figure 11:
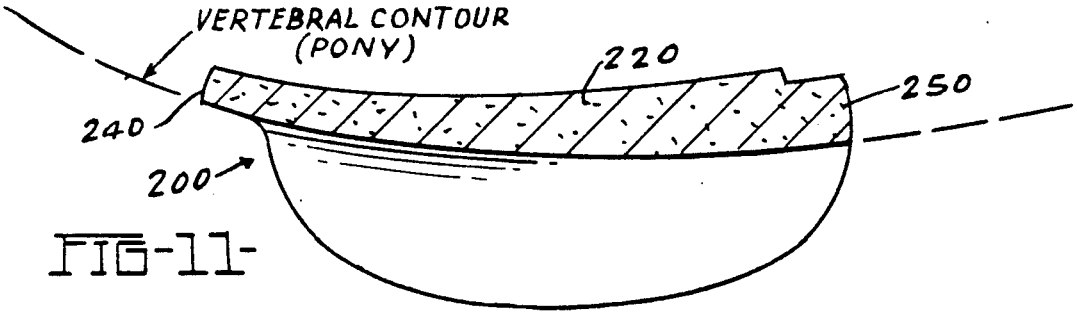
FIG. 11 is a cross-sectional view, from the side of the subject embodiment shown in FIG. 7.
Figure 12:
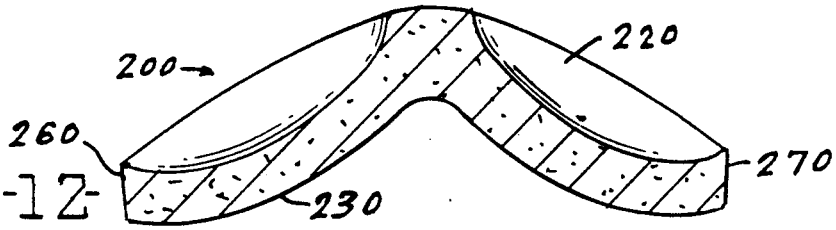
FIG. 12 is an end on cross-sectional view of the embodiment shown in FIG. 7.

Referring now to the drawings, shown in FIGS. 7 through 12, shown is an alternate embodiment to that shown in FIGS. 1 through 6. Shown in FIGS. 7 through 12 is a seat riser pad, which is constructed slightly differently from that shown in FIGS. 1 through 6, as set forth by the following description. A saddle seat riser pad 200 is shown having an upper surface 220 and a lower surface 222, and also having a left side edge 260 and a right side edge 235. Such seat riser pad 200 additionally has a frontal edge 240 and a posterior edge 250. As can be seen in the drawings, the lower surface of such seat riser pad 200 is convex longitudinally to conform to the middle back portion contour of a horse, as shown in FIG. 11. Further, as seen in the drawings, the under surface of such seat saddle riser pad 200 is folded downward, in the concave manner shown in FIGS. 7, 9, 10 and 12, and by such shape the upper surface of such saddle seat riser pad is convex to receive conformingly the lower or under surface of a riding saddle, not shown. The upper apex or upper longitudinal ridge 285 of the upper surface 220 of the seat riser pad 200 extends longitudinally along the upper midsection of the upper surface 220 of the seat saddle riser pad 220 from close to the posterior edge 250 to the frontal edge 240, as seen. This upper ridge 285 has a minimal upper surface width. On the frontal edge of the seat riser pad 200 is an upwardly and forwardly extending extension member 340 used to conform to the seat riser pad to all types of saddles.

Figure 7:
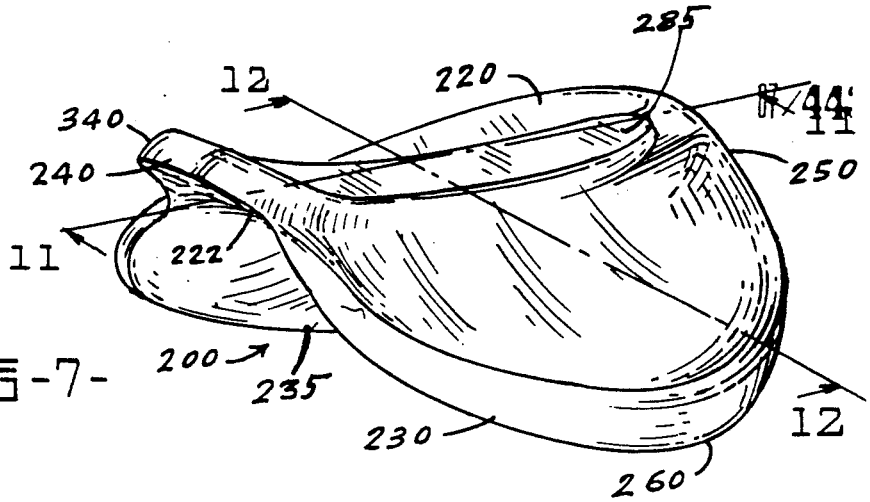
FIG. 7 is a perspective view of an alternate embodiment of the subject invention.
Figure 9:
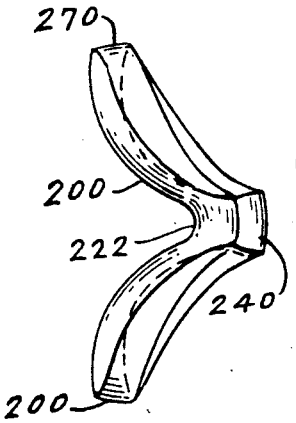
FIG. 9 is an end elevational view of the embodiment shown in FIG. 7.
Figure 8:
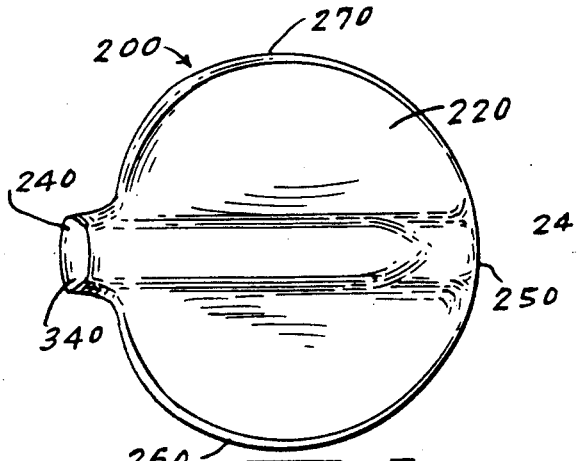
FIG. 8 is a top elevational view of the embodiment show in FIG. 7.
Figure 10:
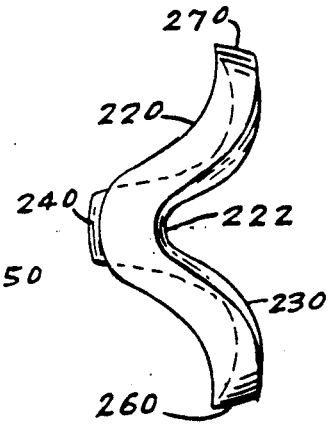
FIG. 10 is a posterior end view of the embodiment shown in FIG. 7.

As shown in FIGS. 7 and 11, the side edges 260 and 235 taper downwardly in width from the posterior edge 250 to the frontal edge 240.

The seat riser pads shown in all the drawings are placed conformingly over the horse's back, and the saddle is placed conformingly over top of the seat riser pad once placed over the horse's back. In summary therefore, the subject invention is a saddle backing member comprising a saddle backing member comprising a one-piece member having an upper surface and lower surface, with such lower surface being concave and such upper surface being convex, with such saddle backing member having side edges and a frontal edge and a posterior edge, and wherein the frontal edge is smaller in thickness than the posterior edge. In further summary, the subject invention is a saddle seat riser pad comprising a one-piece member having an upper surface and lower surface, with such lower surface being concave and such upper surface being convex, with such saddle backing member having side lateral edges and a frontal edge and a posterior edge, and wherein the side lateral edges taper in thickness from the posterior edge to the frontal edge, with the tapering being from a greater thickness starting near the posterior edge and narrowing to a smaller thickness towards the frontal edge. In yet further summary, the subject invention is a saddle seat riser pad comprising a one-piece member having an upper surface and lower surface with such lower surface being concave and such upper surface being convex, with such saddle backing member having side edges and a frontal edge and a posterior edge, and wherein the frontal edge is smaller in thickness than the posterior edge, and wherein the upper surface of the saddle seat riser pad has a longitudinal ridge extending longitudinally along the upper middle surface of such seat riser pad, with the frontal edge of such seat riser pad having an upwardly and forwardly extending member therein.

I claim:

1. A saddle seat riser pad comprising a one-piece member having an upper surface and a lower surface, with said lower surface being transversely concave and said upper surface being transversely convex, with said saddle backing member having side edges and a frontal edge and a posterior edge, and wherein the frontal edge is smaller in thickness than the posterior edge, and wherein said pad has a central longitudinal ridge on the upper surface, which ridge slopes downwardly in the middle of said pad in a concave manner.

2. A saddle backing member comprising a one-piece member having an upper surface and lower surface, with said lower surface being transversely concave and said upper surface being transversely convex, with said saddle backing member having side lateral edges and a frontal edge and a posterior edge, and wherein the side lateral edges taper in thickness from the posterior edge to the frontal edge, with the tapering being from a greater thickness starting near the posterior edge and narrowing to a smaller thickness towards the frontal edge, and wherein said pad has a central longitudinal ridge on the upper surface, which ridge slopes downwardly in the middle of said pad in a concave manner.

3. A saddle seat riser pad comprising a one-piece member having an upper surface and lower surface, with said lower surface being transversely concave and said upper surface being transversely convex, with said saddle backing member having side edges and a frontal edge and a posterior edge, and wherein the frontal edge is smaller in thickness than the posterior edge, and with the frontal edge of said seat riser pad having an upwardly and forwardly extending member thereon, and wherein said pad has a central longitudinal ridge on the upper surface, which ridge slopes downwardly in the middle of said pad in a concave manner.

* * * * *